US006729312B2

(12) United States Patent
Furushou

(10) Patent No.: US 6,729,312 B2
(45) Date of Patent: May 4, 2004

(54) FUEL VAPOR TREATMENT APPARATUS

(75) Inventor: Masaya Furushou, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/342,215

(22) Filed: Jan. 15, 2003

(65) Prior Publication Data

US 2003/0154963 A1 Aug. 21, 2003

(30) Foreign Application Priority Data

Feb. 15, 2002 (JP) ..... 2002-039118

(51) Int. Cl.[7] ..... F02M 25/08; F02M 33/02
(52) U.S. Cl. ..... 123/520
(58) Field of Search ..... 123/516, 518, 123/519, 520, 521

(56) References Cited

U.S. PATENT DOCUMENTS 5,429,098 A 7/1995 Tomisawa
5,606,955 A * 3/1997 Yuda ..... 123/520
5,634,451 A 6/1997 Tomisawa
5,682,863 A * 11/1997 Kadooka ..... 123/520
5,694,904 A * 12/1997 Osanai ..... 123/520
5,746,187 A * 5/1998 Ninomiya et al. ..... 123/520
5,862,795 A * 1/1999 Osanai ..... 123/520
6,681,746 B1 * 1/2004 Cook et al. ..... 123/520

FOREIGN PATENT DOCUMENTS

JP 5-215020 A 8/1993
JP 6-229330 A 8/1994
JP 6-280688 A 10/1994
JP 7-139440 A 5/1995
JP 8-261074 A 10/1996

* cited by examiner

*Primary Examiner*—Weilun Lo
(74) *Attorney, Agent, or Firm*—Shinjyu Global IP Counselors, LLP.

(57) ABSTRACT

A fuel vapor treatment apparatus for an internal combustion engine is configured to improve the purge control performance of a purge control valve. The fuel vapor treatment apparatus includes a purge control valve, an operating condition detector, a purge gas flow rate setting component and a control unit. The control unit outputs a duty value and a drive frequency to the purge control valve to duty control the opening and closing of the purge control valve when prescribed operating conditions are met. The control unit sets a high drive frequency used for duty control of the purge control valve during a low flow rate control of the purge gas and to a low drive frequency during a high flow rate control of the purge gas.

12 Claims, 7 Drawing Sheets

FUEL VAPOR TREATMENT APPARATUS

BACKGROUND OF THE INVENTION

1. Field of the Invention

The present invention generally relates to a fuel vapor treatment apparatus for an internal combustion engine.

2. Background Information

Internal combustion engines are sometimes provided with a fuel vapor treatment apparatus or system having a canister that temporarily adsorbs fuel vapor generated inside the fuel tank. When the engine enters prescribed engine operating conditions, the adsorbed fuel vapor is separated and mixed with air to form a purge gas. A purge control valve opens to direct the purge gas to a purge passage that feeds the purge gas into an intake system of a fuel system while controlling the flow rate of the purge control valve. As a result, evaporation of fuel vapors into the atmosphere is prevented. Generally, the opening and closing of the purge control valve to control the flow rate of the purge gas is typically duty controlled. One example of such a fuel vapor treatment apparatus is disclosed in Japanese Laid-Open Patent Publication No. 5-215020.

In recent years, more stringent regulations regarding fuel vapor evaporative emissions have led to fuel vapor treatment apparatuses that use large capacity canister with increased purge rates (quantity of fuel vapor purged per unit of time).

In view of the above, it will be apparent to those skilled in the art from this disclosure that there exists a need for an improved fuel vapor treatment apparatus that improves the purge control performance of a purge control valve. This invention addresses this need in the art as well as other needs, which will become apparent to those skilled in the art from this disclosure.

SUMMARY OF THE INVENTION

It has been discovered that when larger purge control valves are used to satisfy the aforementioned demand for increased purge rates, the sudden change in flow rate of the purge gas is large when purging is started at a low purge gas flow rate. Moreover, the use of a large purge control valve can result in an increase in air-fuel ratio fluctuations when a low purge gas flow rate control is executed during idling and other times when the intake air flow rate is small. As a result, it is easy for poor operating performance to occur in using such fuel vapor treatment apparatuses.

In view of the aforementioned problems with the prior art, one object of the present invention is to provide an internal combustion engine fuel vapor treatment apparatus that is durable and can eliminate the sudden change in flow rate that occurs when purge control starts, even when a large capacity purge control valve is used.

The forgoing object can basically be attained by providing a fuel vapor treatment apparatus for an internal combustion engine that basically comprises a purge control valve, an operating condition detector, a purge gas flow rate setting component and a control unit. The purge control valve is configured to open and close a purge passage that introduces purge gas containing fuel vapor into an air intake system of the engine to control a purge gas flow rate of the purge gas. The operating condition detector is configured to detect at least one engine operating condition. The purge gas flow rate setting component is configured to set the purge gas flow rate of the purge gas quantity to be supplied to the air intake system based on the engine operating condition detected by the operating condition detector. The control unit is configured to output a duty value and a drive frequency to the purge control valve to duty control the opening and closing of the purge control valve. The control unit sets a high drive frequency during a low flow rate control of the purge gas and sets a low drive frequency during a high flow rate control of the purge gas.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
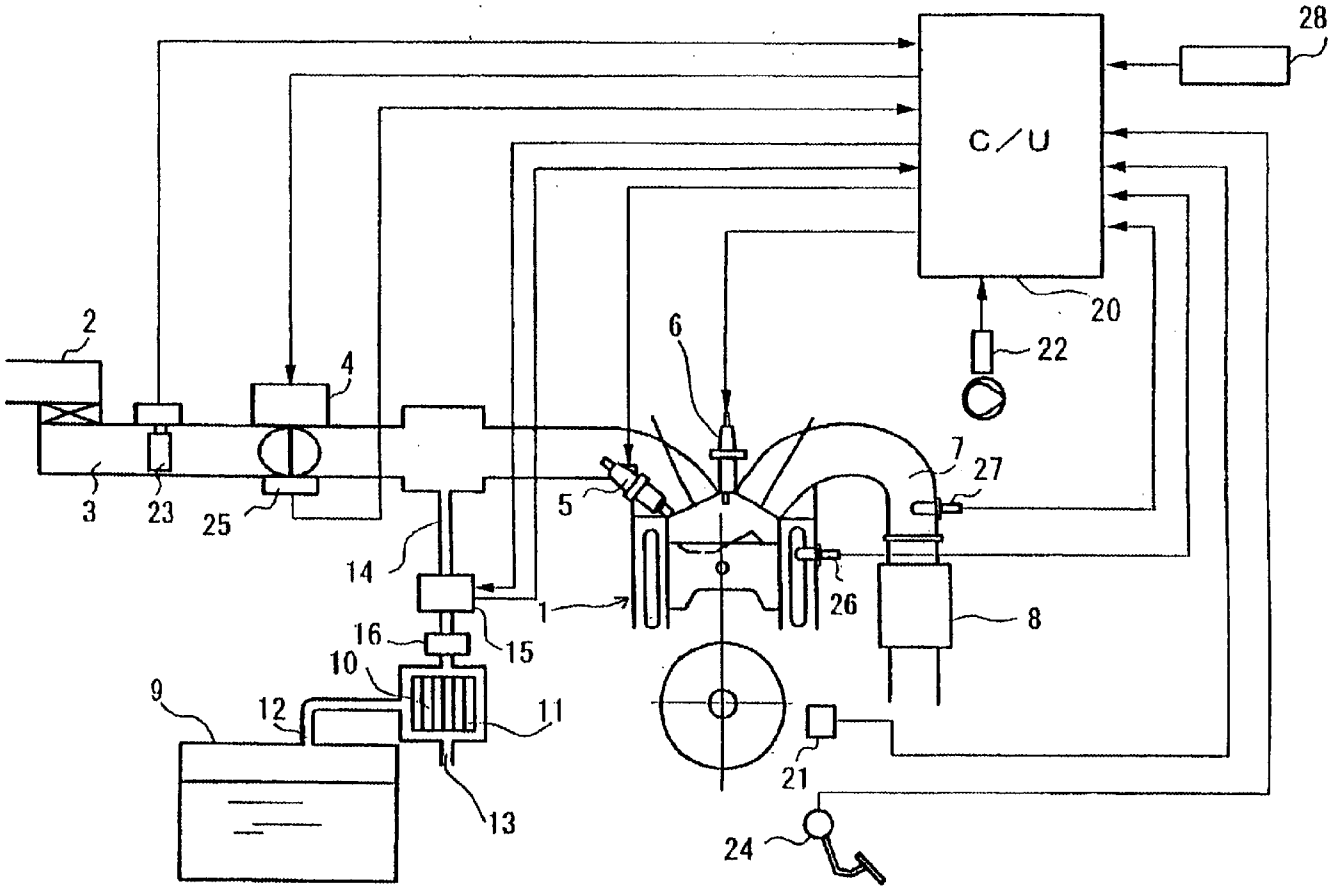
FIG. 1 is a schematic view of a system configuration of an internal combustion engine exhaust gas cleaning apparatus with a fuel vapor treatment apparatus in accordance with one embodiment of the present invention.

Referring initially to FIG. 1, a system configuration for a vehicle internal combustion engine is schematically illustrated that includes a fuel vapor treatment apparatus in accordance with a first embodiment of the present invention. In FIG. 1, an internal engine 1 is mounted in a vehicle and air is introduced into the combustion chamber of each cylinder through an air cleaner 2, an intake pipe 3 and an electronically controlled throttle valve 4. In this embodiment, the electronically controlled throttle valve 4 is a system arranged such that the valve body of the throttle valve is opened and closed by a motor or other actuator, but it is also acceptable to use a throttle valve that is interlocked with the accelerator pedal.

In this embodiment, a solenoid-type fuel injection valve 5 is provided for each cylinder such that fuel (gasoline) is injected directly into the combustion chamber of each cylinder. It is also acceptable to use fuel injection valves arranged to inject fuel into the intake passage.

Each of the fuel injection valves 5 opens and injects fuel at a prescribed pressure when its solenoid is energized by an injection pulse signal sent from a control unit 20. Then, the air-fuel mixture formed inside the combustion chamber is ignited by a spark plug 6 controlled by an ignition signal from control unit 20.

The internal combustion engine 1 is not limited to the direct fuel injection arrangement just described; it is also acceptable for the engine to be configured such that the fuel is injected into the intake port.

Exhaust gas is discharged from the internal combustion engine 1 through an exhaust pipe 7 and a catalytic converter 8 for cleaning the exhaust gas. The catalytic converter 8 is arranged within the exhaust pipe 7 in a conventional manner.

As seen in FIG. 1, a schematic view of a fuel vapor treatment apparatus is illustrated in accordance with a first embodiment of the present invention. The fuel vapor treatment apparatus is arranged and configured to treat fuel vapors generated inside a fuel tank 9 by using a canister 10 containing a fuel adsorbing material 11 (e.g., activated carbon). The canister 10 is an airtight container filled with the adsorbing material 11. The canister 10 is fluidly connected to the fuel tank 9 via a fuel vapor guide pipe 12. Thus, when the internal combustion engine 1 is stopped fuel vapors produced in the fuel tank 9 are directed to the canister 10 through the fuel vapor guide pipe 12 and collected by adsorption in the canister 10.

The canister 10 is also provided with a fresh air inlet 13 and a purge passage or pipe 14. The purge pipe 14 has a purge control valve 15 installed therein. The purge control valve 15 is duty-controlled by a control signal (duty value and drive frequency) from the control unit 20. The purge control valve 15 is preferably a solenoid valve that is configured to open and close the purge passage or pipe 14 that introduces purge gas containing fuel vapor into the air intake system of the engine 1 to control a purge gas flow rate of the purge gas. The purge pipe 14 also includes a concentration sensor 16 that detects the concentration M of the purge gas flowing through the purge pipe 14. The concentration sensor or detector 16 produces a detection signal indicative of the concentration M of the purge gas in the purge passage 14. This detection signal from the concentration sensor 16 is sent to the control unit 20 to calculate the purge gas flow rate using a fuel injection quantity correction coefficient as explained below. Thus, the control unit 20 includes a purge gas flow rate setting component that is configured to set the purge gas flow rate of the purge gas quantity to be supplied to the air intake system based on the engine operating conditions (i.e., including, but not limited to, the engine rotational speed Ne, the intake air flow rate Qa, the concentration M) detected by the engine operating condition detectors or sensors 16 and 21–28 as discussed below. The purge gas flow rate setting component of the control unit 20 is set forth in the flow chart of FIG. 3 as explained below.

When the purge gas flow rate is measured with a flow rate sensor, measurement error occurs because of chemical changes and changes in the specific weight of the purge gas in response to the fuel vapor concentration. By calculating the purge gas flow rate based on the concentration of fuel vapor in the purge gas and a correction value used to correct the fuel injection quantity, such measurement error can be avoided and the flow rate can be calculated with a high degree of precision.

When the purge control valve 15 is opened, the intake vacuum pressure of the internal combustion engine 1 acts on the canister 10 and air introduced through a fresh air inlet 13 causes fuel vapor adsorbed to the adsorbing material 11 inside the canister 10 to be purged. A purge gas containing the purged fuel vapor passes through the purge pipe 14 and is drawn to the downstream side of the electronically controlled throttle valve 4 of the intake pipe 3. Next, the purge gas is combusted inside a combustion chamber of the internal combustion engine 1.

It will be apparent to those skilled in the art from this disclosure that the present invention is the most effective when applied to the control of the purge control valve 15, which installed in the purge pipe 14 of the canister 10 that adsorbs fuel vapor from the fuel tank 9, where the amount of fuel vapor is the largest.

The control unit 20 preferably includes a microcomputer that includes a CPU with a control program that controls the fuel vapor treatment apparatus as discussed below. The control unit 20 also includes other conventional components such as an input interface circuit, an output interface circuit, and storage devices such as a ROM (Read Only Memory) device and a RAM (Random Access Memory) device. The internal RAM of the control unit 20 stores statuses of operational flags and various control data. The microcomputer of the control unit 20 is programmed to control the opening and closing of the purge control valve 15. The control unit 20 is operatively coupled to the purge control valve 15 in a conventional manner. The control unit 20 is configured to output a duty value and a drive frequency to the purge control valve 15 to duty control the opening and closing of the purge control valve 15. As explained below, the control unit 20 sets a high drive frequency during a low flow rate control of the purge gas and setting a low drive frequency during a high flow rate control of the purge gas. The internal RAM of the control unit 20 stores statuses of operational flags and various control data. It will be apparent to those skilled in the art from this disclosure that the precise structure and algorithms for control unit 20 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

In the present invention, the control unit 20 is configured such that when the drive frequency is changed from a high frequency to a low frequency, the duty value is set by using a conversion that uses the maximum slope (slope: flow rate/duty value) of the purge control valve flow rate characteristic at the low frequency. As a result, even if part variations are taken into consideration, the fuel injection quantity can be corrected without the reduction amount exceeding the limit value and good combustion can be maintained. Moreover, in the present invention, the control unit 20 is configured such that the drive frequency is changed at a target flow rate value a that was set in advance in relation to an inflection point of the purge control valve flow rate characteristic. Thus, with the present invention, the purge control valve 15 can be used in a range where it exhibits a stable flow rate characteristic, for improving the control precision.

As mentioned above, in the present invention, the control unit 20 is configured to set a high frequency during low flow rate control of the purge gas. Therefore, sudden changes in air-fuel ratio associated with starting purging can be suppressed and stable controllability can be ensured when the purge control valve 15 has a large capacity. Meanwhile, since the control unit 20 is configured to use a low drive frequency for high flow rates, the number of opening and closings can be reduced and durability can be ensured.

Furthermore, in the present invention, the control unit 20 is configured such that the duty value used immediately after the drive frequency is changed is set such that the purge gas flow rate is less than or equal to the purge gas flow rate existing immediately before the drive frequency was changed.

During purge control, if the fuel injection quantity has already been corrected to a lower value and the purge gas flow rate increases immediately after the drive frequency is changed, then there is the risk that the required reduction of the fuel injection quantity will exceed the limit value and the air-fuel ratio will become excessively rich. With the present invention, however, the control unit 20 is configured such that the duty value is set to a slightly lower value immediately after the drive frequency is changed so that the purge gas flow rate will be no larger immediately after the change than it was immediately before the change. As a result, the air-fuel ratio can be prevented from becoming excessively rich and stable operation can be ensured.

In the present invention, when the drive frequency is changed by the control unit 20, the duty value to be used after the change is set based on the purge control valve duty value used and the purge gas flow rate existing before the change. With the present invention, the duty value used after the drive frequency is changed can be set by the control unit 20 so as to take into consideration the variation in the purge control valve flow rate characteristic (flow rate versus duty value). As a result, the flow rate error caused by changing the drive frequency can be reduced and air-fuel ratio fluctuations can be suppressed.

Also as explained below in more detail, the control unit 20 of the present invention is configured such that the purge gas flow rate existing before the drive frequency was changed is calculated based on the concentration M of fuel vapor in the purge gas and a correction value for the fuel injection quantity injected into the engine from the fuel injection valves 5.

The control unit 20 receives input or detection signals from various sensors. Based on these signals, the control unit 20 controls the operation of the fuel injection valves 5, the spark plugs 6 and the purge control valve 15. In particular, the control unit 20 is operatively coupled to a crank angle sensor 21, a cam sensor 22, an airflow meter 23, an accelerator sensor 24, a throttle sensor 25, a coolant temperature sensor 26, an air-fuel ratio sensor 27 and a vehicle speed sensor 28. The crank angle sensor 21 detects the crank angle of the internal combustion engine 1 and produces an input or detection signal indicative of the crank angle of the internal combustion engine 1, which is sent to the control unit 20. The engine rotational speed Ne is computed based on the detection signal from the crank angle sensor 21. The cam sensor 22 detects the position (open/closed) of the intake and exhaust valves for each cylinder and produces an input signal indicative of valve positions for each cylinder, which is sent to the control unit 20. The airflow meter 23 detects the intake air flow rate Qa upstream of the electronically controlled throttle valve 4 in the intake pipe 3 and produces an input signal indicative of the intake air flow rate, which is sent to the control unit 20. The accelerator sensor 24 detects the amount APS by which the accelerator pedal is depressed (accelerator pedal position) and produces an input signal indicative of the accelerator pedal position, which is sent to the control unit 20. The throttle sensor 25 detects the throttle valve opening TVO of the electronically controlled throttle valve 4 and produces an input signal indicative of the throttle valve position, which is sent to the control unit 20. The coolant temperature sensor 26 detects the coolant temperature Tw of the engine 1 and produces an input signal indicative of the engine coolant temperature, which is sent to the control unit 20. The air-fuel ratio sensor 27 detects the air-fuel ratio of the exhaust gas based on the concentration of oxygen in the exhaust gas and produces an input signal indicative of the air-fuel ratio of the exhaust gas, which is sent to the control unit 20. The vehicle speed sensor 28 detects the vehicle speed VSP and produces the input signal indicative of a vehicle speed, which is sent to the control unit 20.

Air-fuel ratio feedback control is executed which sets an air-fuel ratio feedback coefficient that serves to correct the fuel injection quantity so as to make the exhaust gas air-fuel ratio detected by the air-fuel ratio sensor 27 match a target air-fuel ratio. This air-fuel ratio feedback control is executed under prescribed operating conditions, and purging of fuel vapor from the canister 10 is only executed when the air-fuel ratio feedback control is being executed.

In a fuel vapor treatment apparatus for an internal combustion engine constituted as just described, the present invention executes duty control of the purge control valve 15 by changing the frequency depending on the flow rate region and the duty value.

Figure 2:
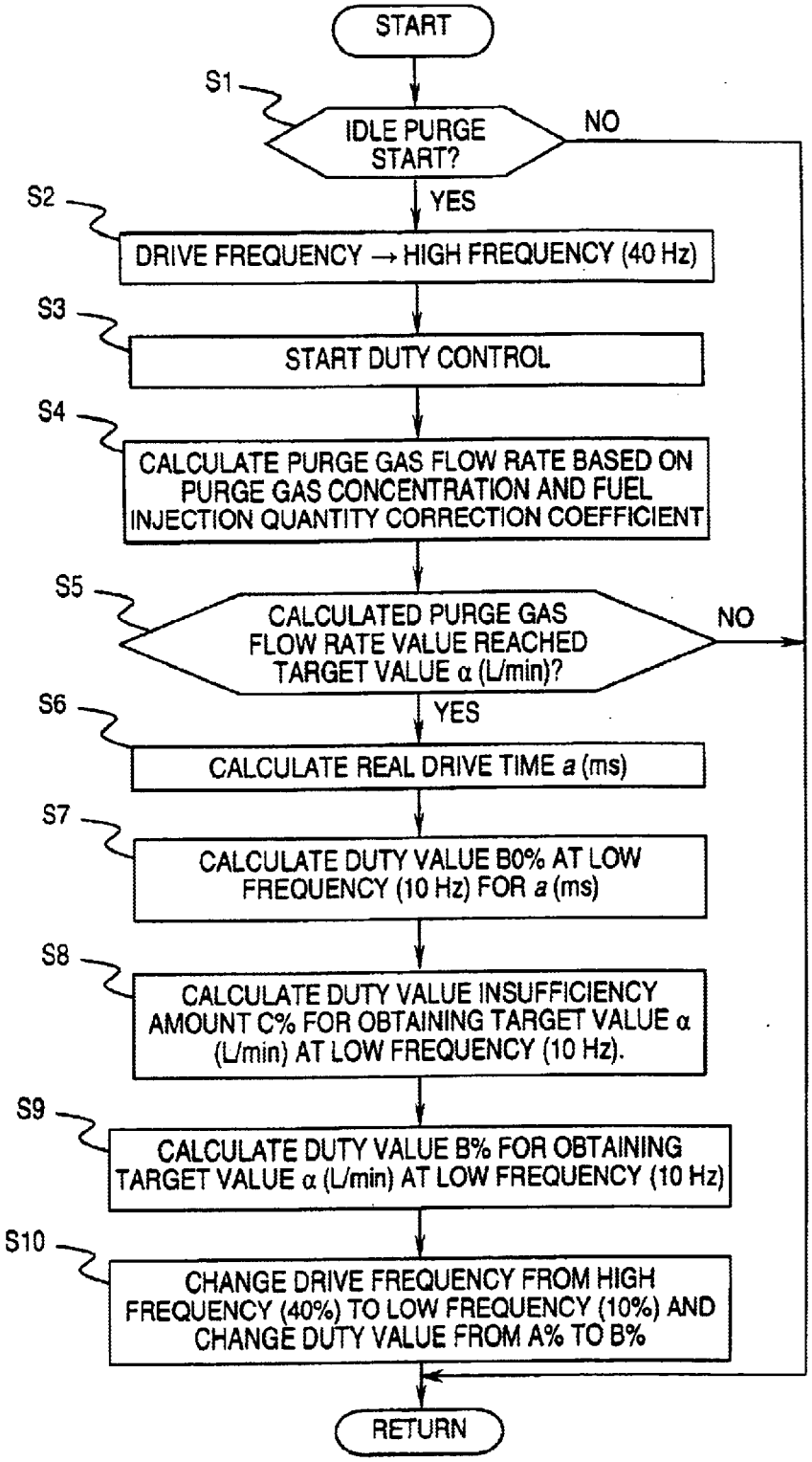
FIG. 2 is a control flowchart used in performing the main routine for purge control operation in accordance with the embodiment of the present invention illustrated in FIG. 1.

Now, the duty control of the purge control valve 15 in this embodiment of the present invention will be described using the flowchart shown in FIG. 2.

In step S1, the control unit 20 determines if the engine 1 is idling and if the engine 1 is in an engine operating state in which purging should be executed. If the engine 1 is determined to be idling and in the engine operating state in which purging should be executed, the control unit 20 proceeds to step S2 and sets the drive frequency for the purge control valve 15 to a high drive frequency, namely 40 Hz in the illustrated embodiment.

In step S3, the control unit 20 starts duty control at the high drive frequency set in the previous step S2.

Figure 3:
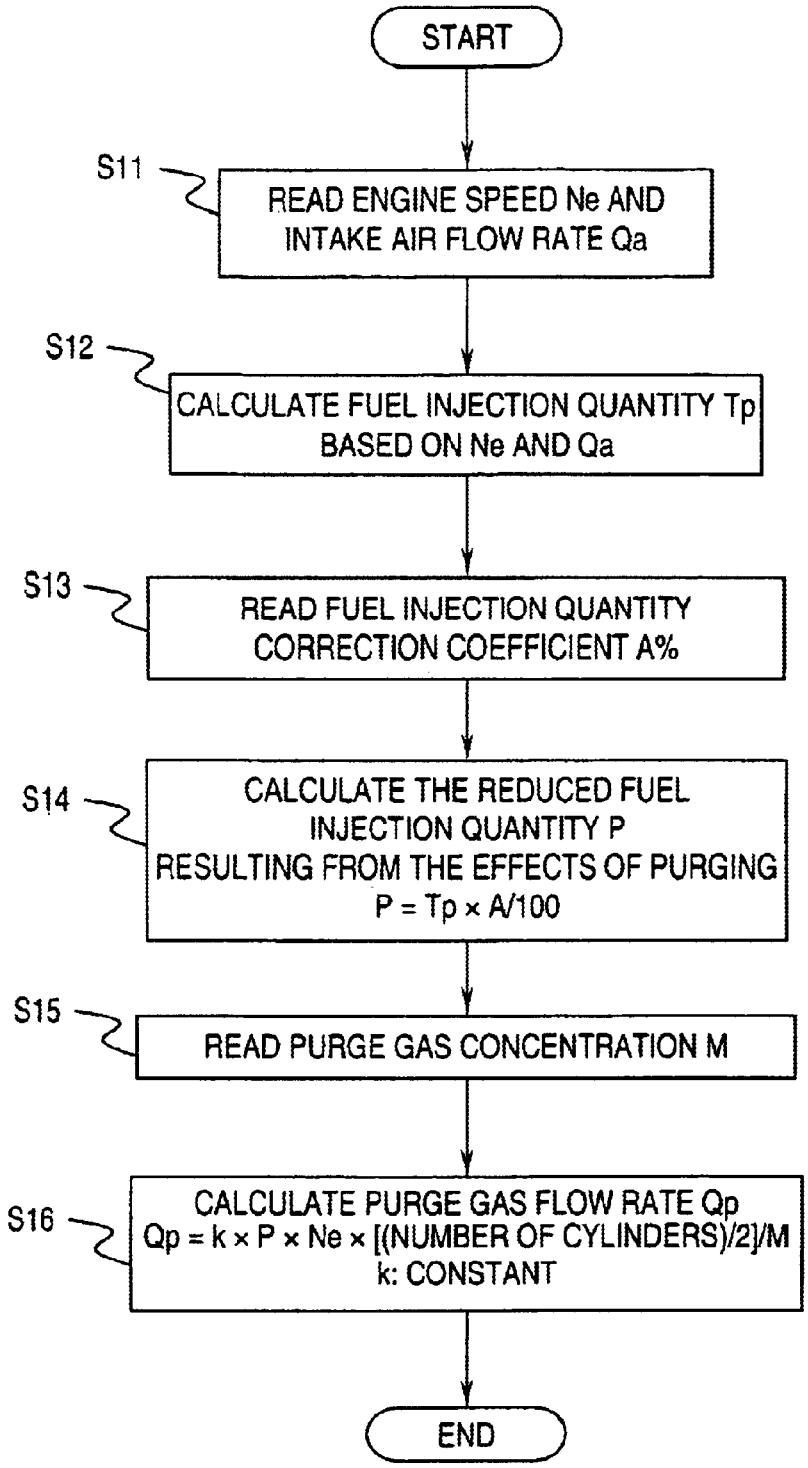
FIG. 3 is a control flowchart of a subroutine used to calculate the purge gas flow rate during the purge control operation in accordance with the embodiment of the present invention illustrated in FIGS. 1 and 2.

In step S4, the control unit 20 calculates the purge gas flow rate based on the purge gas concentration M detected by the concentration sensor 16 and the fuel injection quantity correction coefficient. FIG. 3 shows a flowchart of the operating routine used to calculate the flow rate of the fuel vapor purge gas in step S4. The calculation of the flow rate of the fuel vapor purge gas in step S4 will now be discussed with reference to FIG. 3.

In step S11, the control unit 20 determines the engine speed Ne based on the detecting signal from the crank angle sensor 21 and the intake air flow rate Qa based on the signal from the airflow meter 23.

In step S12, the control unit 20 calculates or obtains the basic fuel injection quantity Tp from a control map based on the aforementioned engine speed Ne and the intake air flow rate Qa.

In step S13, the control unit 20 calculates and reads the correction percentage A % for the fuel injection quantity (i.e., the correction percentage of the air-fuel ratio feedback correction coefficient $\alpha$).

In step S14, the control unit 20 calculates the reduced fuel injection quantity P resulting from the effects of purging using the following equation: $P=Tp\times A/100$.

In step S15, the control unit 20 reads the purge gas concentration M from the concentration sensor 16.

In step S16, the control unit 20 calculates the purge gas flow rate Qp using the following equation: $Qp=k\times P\times Ne\times[(\text{number of cylinders})/2]/M$, where k is a prescribed constant.

Referring back to FIG. 2, in step S5, the control unit 20 determines if the purge gas flow rate estimated in step S16 has reached a target value $\alpha$ (L/min). If the target value $\alpha$ has been reached, then the control unit 20 proceeds to step S6.

In step S6, the control unit 20 calculates a real drive time a (ms) of the purge control valve 15 at that point in time. The real drive time a varies depending on the inactive time such that the larger the inactive time is, the longer the drive time $\alpha$ will be.

In step S7, the control unit 20 calculates the duty value B0% at the low frequency corresponding to the aforementioned drive time $\alpha$ (ms), e.g., at a low drive frequency of 10 Hz. This duty value B0% is the product of the duty value A % at a high drive frequency of 40 Hz and the frequency ratio (10/40) of the low drive frequency to the high drive frequency. For example, with a low drive frequency of 10 Hz and a high drive frequency of 40 Hz, the duty value B0% would be one-fourth of the duty value A % (i.e., B0%=A %/4).

In step S8, the control unit 20 calculates a duty value insufficiency amount C %, which is the amount by which the aforementioned duty value B0% should be increased to obtain the target flow rate value $\alpha$ (L/min) at a low drive frequency of 10 Hz.

The purge gas flow rate obtained at a drive frequency of 10 Hz and a duty value of B0% is the value $\alpha/4$ (L/min) obtained by multiplying the target value $\alpha$ (L/min) by the frequency ratio (10/40). The duty value insufficiency amount C % required to obtain the amount $3\alpha/4$ (L/min) by which the purge gas flow rate is insufficient is calculated by dividing the insufficiency amount $3\alpha/4$ (L/min) by the maximum slope t (flow rate/duty value) of the flow rate characteristic (flow rate versus duty value) shown in FIGS. 4–6.

In step S9, the duty value B % at the final drive frequency of 10 Hz is calculated using the following equation: $B\%=B0\%+C\%=A\%/4+(3\alpha/4)t$.

Since the duty value corresponding to the amount by which the purge gas flow rate is insufficient is calculated by dividing by the maximum slope t of the purge control valve flow rate characteristic, it is smaller than the actual insufficiency amount.

In step S10, the control unit 20 changes the drive frequency of the purge control valve 15 from the high drive frequency (40 Hz) to the low drive frequency (10 Hz) and changes the duty value from A % to B %.

Thus, by setting the drive frequency of the purge control valve 15 to a high drive frequency when the purge gas flow rate is in a low flow rate region, the sudden change in air-fuel ratio associated with the start of the purging operation can be suppressed and a stable purging operation can be ensured even when the purge control valve 15 has a large capacity. Also, by using a low drive frequency for high flow rates, the number of openings and closings of the purge control valve 15 can be reduced to ensure a precise flow rate and increase durability of the purge control valve 15.

Also, since the duty value after the change is set based on the purge gas flow rate and duty cycle before the change (through the calculation of the real drive time $\alpha$), the flow rate error caused by changing the drive frequency can be reduced even if there is variation in the purge control valve flow rate characteristic (flow rate versus duty value).

Figure 4:
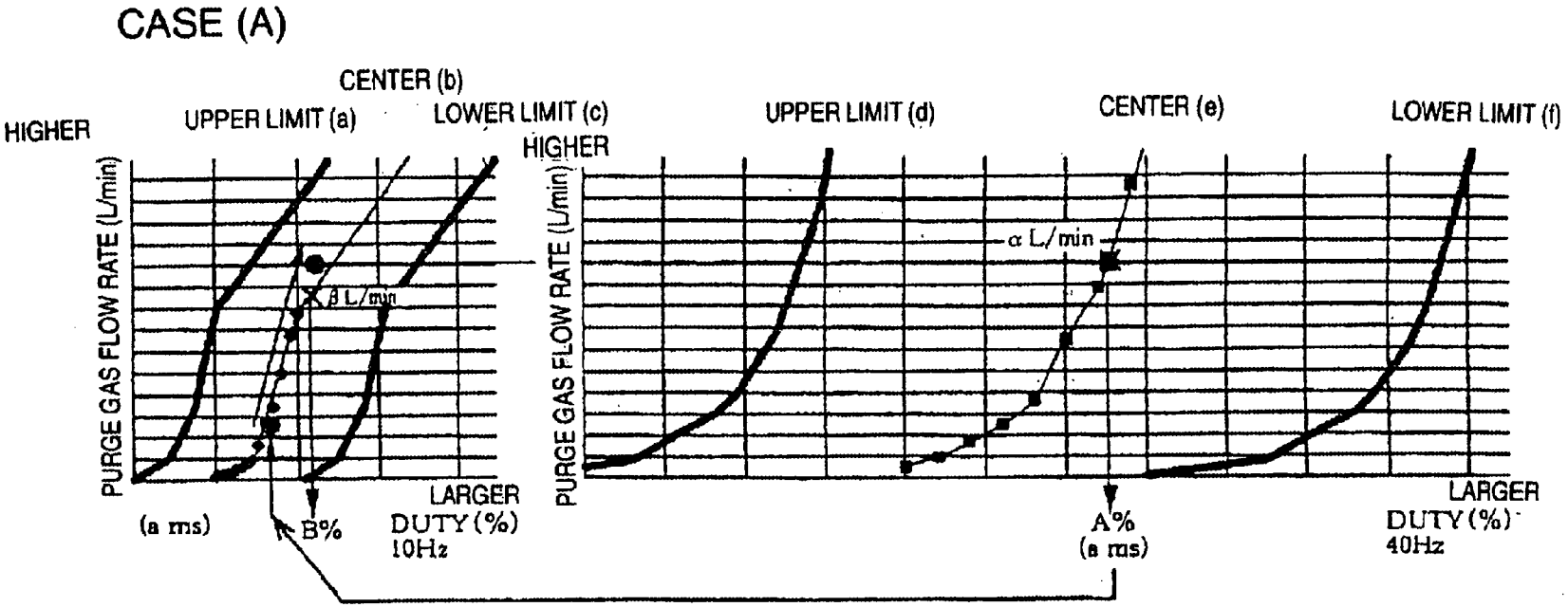
FIG. 4 is a graph that illustrates a first case (A) where there is no variation in the purge control valve flow rate characteristic when the driving frequency of the purge control valve is changed in accordance with the embodiment of the present invention illustrated in FIGS. 1–3.
Figure 5:
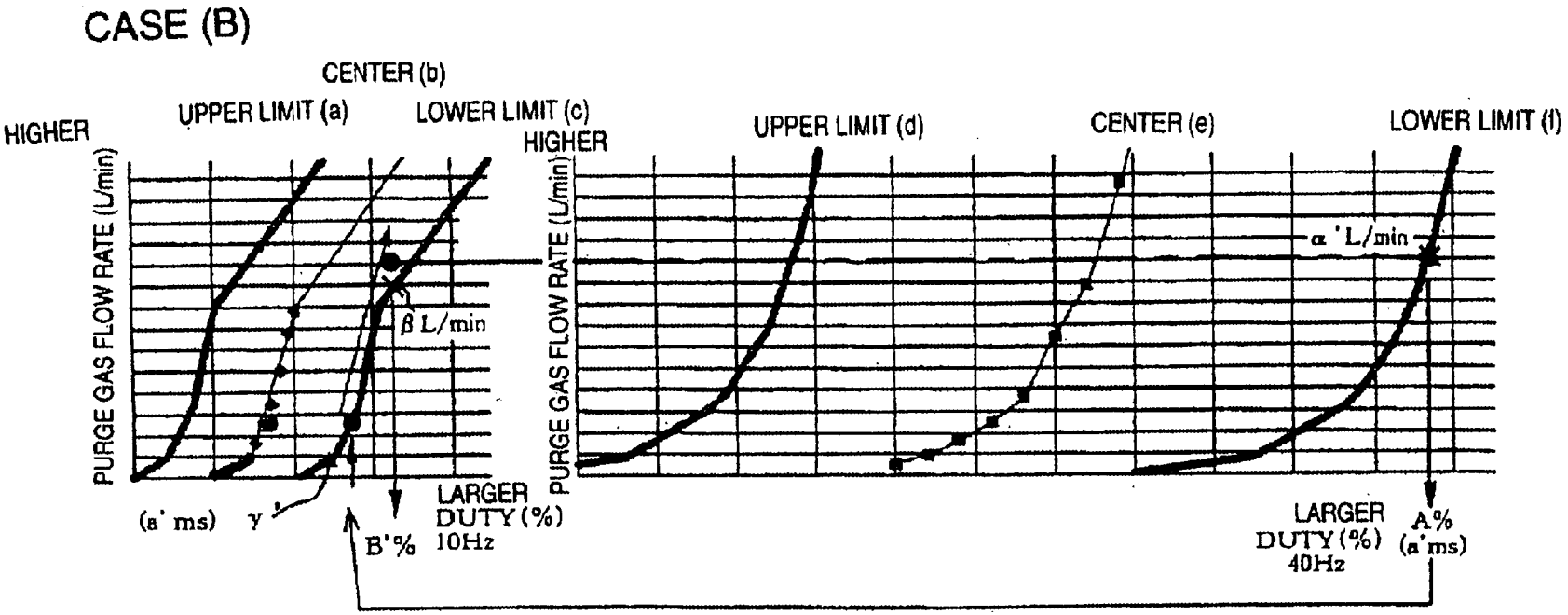
FIG. 5 is a graph that illustrates a second case (B) where the purge control valve flow rate characteristic is at the lower limit of the variation when the driving frequency of the purge control valve is changed in accordance with the embodiment of the present invention illustrated in FIGS. 1–3.
Figure 6:
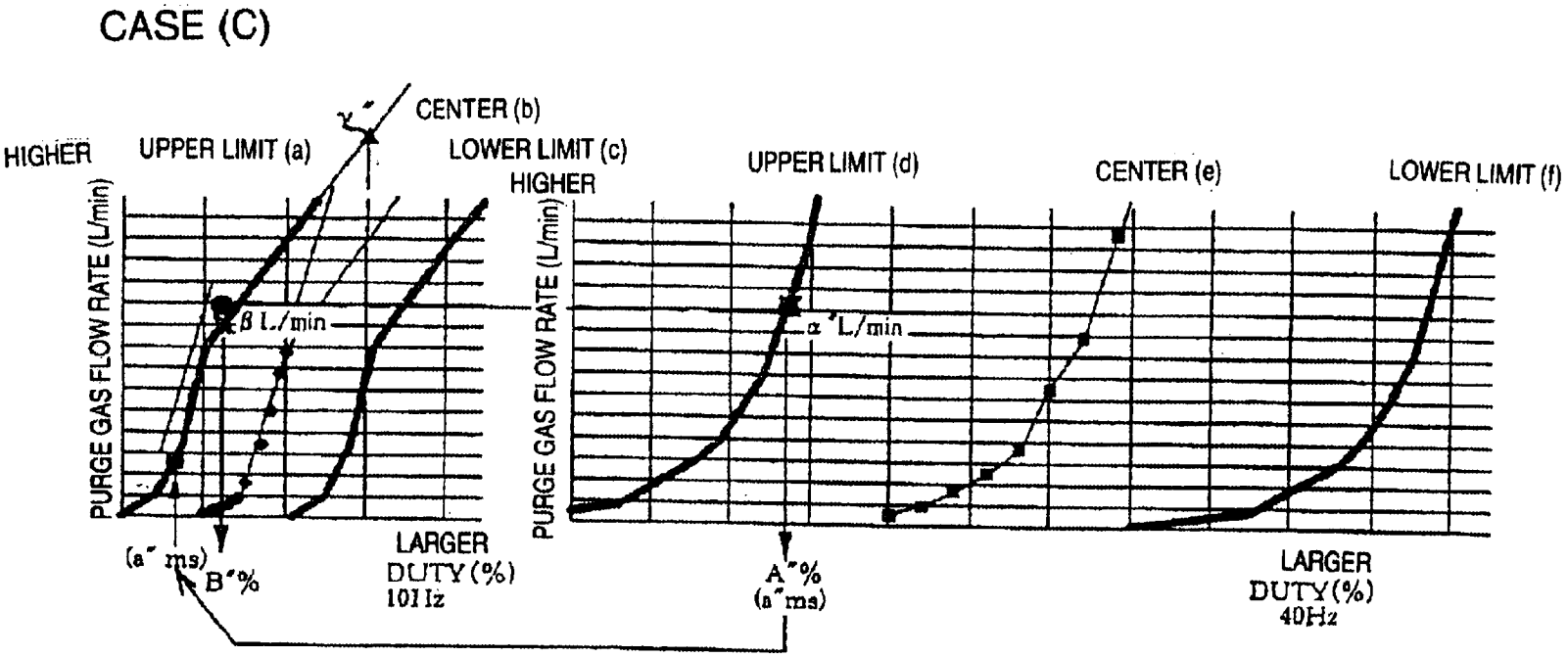
FIG. 6 is a graph that illustrates a third case (C) where the purge control valve flow rate characteristic is at the upper limit of the variation when the driving frequency of the purge control valve is changed in accordance with the embodiment of the present invention illustrated in FIGS. 1–3.

FIGS. 4–6 illustrate why this is the case. Case (A) of FIG. 4 shows when there is no variation in the purge control valve flow rate characteristic and the purge control valve flow rate characteristic is at the central value. Case (B) of FIG. 5 shows when the purge control valve flow rate characteristic is at the lower limit of the variation. Case (C) of FIG. 6 shows when the purge control valve flow rate characteristic is at the upper limit of the variation. In short, there are lower and upper limits to the variation of the purge control valve flow rate characteristic with respect to the central value (reference value) of the purge control valve flow rate characteristic. Post-frequency-change flow rates $\beta$, $\beta'$, and $\beta''$ (L/min), which are close to pre-frequency-change flow rates $\alpha$, $\alpha'$, and $\alpha''$ (L/min), respectively, can be obtained in Cases (A), Case (B) and Case (C).

When the drive frequency is changed from the high drive frequency (40 Hz) to the low drive frequency (10 Hz), if the purge flow rate and the duty value before changing the frequency were ignored and the duty value was set using a control map that assumes the flow rate characteristic is at the central value, then either the flow rate would be essentially zero in a case where the variation of the actual flow rate characteristic of the purge control valve was at the lower limit as indicated by $\gamma'$ in case (B), or the flow rate would be extremely large in a case where the variation of the actual flow rate characteristic of the purge control valve was at the upper limit, as indicated by $\gamma''$ in case (C).

Additionally, when the drive frequency is changed from the high drive frequency to the low drive frequency, the duty value insufficiency amount C % that corresponds to the amount by which the flow rate is insufficient is calculated to be somewhat small [FIGS. 4–6: $\alpha$, $\alpha'$, $\alpha''\rightarrow\beta$, $\beta'$, $\beta''$ ($<\alpha$, $\alpha'$, $\alpha''$)] by using the maximum slope t of the purge control valve flow rate characteristic. Thus, the air-fuel ratio can be reliably prevented from becoming excessively rich when the drive frequency is changed and misfiring (degraded operating performance) can be prevented.

Figure 7:
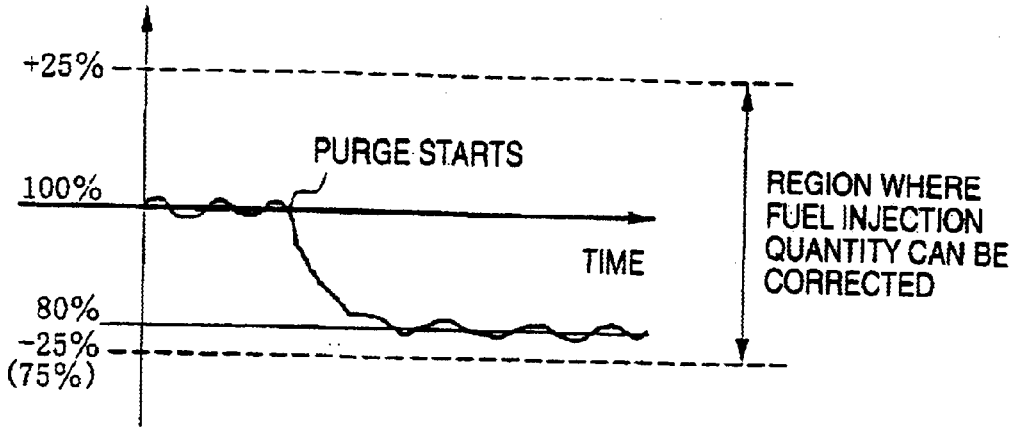
FIG. 7 is a graph that illustrates the change in the fuel injection quantity delivered from the fuel injection valves that occurs during the purge control operation in accordance with the embodiment of the present invention illustrated in FIGS. 1–4.

In short, as shown in FIG. 7, a region, e.g., ±25%, is established within which the fuel injection quantity delivered from the fuel injection valves 5 can be corrected. If noise variation is picked up from the sensors and an incorrect fuel injection quantity is calculated, the incorrect fuel injection quantity is not used as is because the system does not allow quantities exceeding the limiter to be set as the fuel injection quantity.

The fuel injection quantity setting is feedback controlled based on the air-fuel ratio detected by the air-fuel ratio sensor 27. When purging is not executed, the correction value is basically 0 and the fuel injection quantity stays at around 100%.

If changing the drive frequency of the purge control valve 15 causes the purge gas flow rate to increase suddenly due to an undetermined factor, the fuel injection quantity can be reduced by approximately 5% but beyond that the correction upper limit will be reached and the air-fuel ratio will become rich because the fuel injection quantity cannot be corrected further. If the richness of the air-fuel ratio becomes high enough, the engine will misfire.

Conversely, when, as in the embodiment just described, changes are made such that the purge gas flow rate is reduced, the fuel injection quantity is merely corrected so as to increase (return toward 100%) in relation to the amount by which the purge gas flow rate was reduced. Thus, the fuel injection quantity can re-corrected immediately and an appropriate air-fuel ratio can be maintained while suppressing excessive richness.

While the present invention is most effective when applied to the treatment of fuel vapor from a canister, it can also be applied to other purge control systems. For example, the invention can be applied to situation in which blow-by gas containing fuel vapor that has collected in the crankcase is purge-controlled using a control valve to control the suction of the blow-by gas into the air intake system of the engine.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2002-39118. The entire disclosure of Japanese Patent Application No. 2002-39118 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A fuel vapor treatment apparatus for an internal combustion engine comprising:

a purge control valve configured to open and close a purge passage that introduces purge gas containing fuel vapor into an air intake system of the engine to control a purge gas flow rate of the purge gas;

an operating condition detector configured to detect at least one engine operating condition;

a purge gas flow rate setting component configured to set the purge gas flow rate of the purge gas quantity to be supplied to the air intake system based on the engine operating condition detected by the operating condition detector; and a control unit configured to output a duty value and a drive frequency to the purge control valve to duty control the opening and closing of the purge control valve, the control unit setting a high drive frequency during a low flow rate control of the purge gas and setting a low drive frequency during a high flow rate control of the purge gas.

2. The fuel vapor treatment apparatus as recited in claim 1, wherein the control unit being further configured to set the duty value used immediately after the drive frequency is changed such that the purge gas flow rate is less than or equal to the purge gas flow rate existing immediately before changing of the drive frequency.

3. The fuel vapor treatment apparatus as recited in claim 2, wherein the control unit being further configured to set the duty value to be used after changing of the drive frequency based on the duty value used before changing of the drive frequency and the purge gas flow rate existing before changing of the drive frequency.

4. The fuel vapor treatment apparatus as recited in claim 3, wherein the control unit being further configured to calculate the purge gas flow rate existing before the drive frequency was changed based on a concentration of fuel vapor in the purge gas and a correction value for a fuel injection quantity to be injected into the engine from a fuel injection valve.

5. The fuel vapor treatment apparatus as recited in claim 1, wherein the control unit being further configured to set the duty value to be used after changing of the drive frequency based on the duty value used before changing of the drive frequency and the purge gas flow rate existing before changing of the drive frequency.

6. The fuel vapor treatment apparatus as recited in claim 5, wherein the control unit being further configured to calculate the purge gas flow rate existing before the drive frequency was changed based on a concentration of fuel vapor in the purge gas and a correction value for a fuel injection quantity to be injected into the engine from a fuel injection valve.

7. The fuel vapor treatment apparatus as recited in claim 1, wherein the control unit being further configured to set the duty value by using a conversion that uses a maximum slope of the purge gas flow rate to the duty value of a purge control valve flow rate characteristic at the low drive frequency, when the drive frequency is changed from the high drive frequency to the low drive frequency.

8. The fuel vapor treatment apparatus as recited in claim 7, wherein the control unit being further configured to change the drive frequency at a target flow rate that was set in advance in relation to an inflection point of the purge control valve flow rate characteristic.

9. The fuel vapor treatment apparatus as recited in claim 1, wherein the control unit being further configured to change the drive frequency at a target flow rate that was set in advance in relation to an inflection point of a purge control valve flow rate characteristic at the low drive frequency.

10. The fuel vapor treatment apparatus as recited in claim 1, further comprising a fuel tank; and a canister configured to temporarily adsorb fuel vapor evaporated from the fuel tank, the canister being fluidly coupled to the fuel tank by the purge passage having the the purge control valve installed therein.

11. A fuel vapor treatment apparatus for an internal combustion engine comprising:

purge passage open/close means for opening and closing a purge passage that introduces purge gas containing fuel vapor into an air intake system of the engine to control a purge gas flow rate of the purge gas;

operating condition detection means for detecting at least one engine operating condition;

purge gas flow rate setting means for setting the purge gas flow rate of the purge gas quantity to be supplied to the air intake system based on the engine operating condition detected by the operating condition detection means;

a control means for outputting a duty value and a drive frequency to the purge passage open/close means to duty control the opening and closing of the purge passage open/close means, the control means setting a high drive frequency during a low flow rate control of the purge gas and setting a low drive frequency during a high flow rate control of the purge gas.

12. A method of treating fuel vapor for an internal combustion engine comprising:

detecting at least one engine operating condition;

setting a purge gas flow rate of a purge gas quantity to be supplied to an air intake system of the engine by a purge passage that introduces purge gas containing fuel vapor into the air intake system based on the engine operating condition;

determining a duty value for opening and closing duty of the purge passage based on the purge gas flow rate;

setting a drive frequency of opening and closing of the purge passage based on the purge gas flow rate such that a high drive frequency is set during a low flow rate control of the purge gas and a low drive frequency is set during a high flow rate control of the purge gas; and opening and closing the purge passage based on the duty value and the drive frequency.

* * * * *